US005551269A

United States Patent [19]

Lewinstein et al.

[11] Patent Number: 5,551,269

[45] Date of Patent: Sep. 3, 1996

[54] KEYRING AND ATTACHMENT

[76] Inventors: Archie Lewinstein, 160 Valparaiso #16, Cotati, Calif. 94931; Stefan Goya, 15000 Rio Nido Rd., Guerneville, Calif. 95446

[21] Appl. No.: 152,032

[22] Filed: Nov. 1, 1993

[51] Int. Cl.[6] ..... A44B 15/00

[52] U.S. Cl. ..... 70/459; 24/3.6; 70/456 R

[58] Field of Search ..... 70/457, 459, 456 R; 24/3 K, 3 L, 599.2, 3.6

[56] References Cited

U.S. PATENT DOCUMENTS

| | | | |
|---|---|---|---|
| 1,015,149 | 1/1912 | Dills | 24/599.2 X |
| 1,373,867 | 4/1921 | Conner | 70/456 R |
| 1,478,897 | 12/1923 | Frech | 70/456 R |
| 1,525,907 | 2/1925 | Batlle | 24/3 K |
| 2,090,962 | 8/1937 | Peters | 70/456 R |
| 2,218,932 | 10/1940 | Collins | 24/3 K |
| 2,613,422 | 10/1952 | Boden et al. | 24/3 K X |
| 2,620,650 | 12/1952 | Cotti | 70/459 |
| 3,186,052 | 6/1965 | Bobrow | 24/3 K X |

FOREIGN PATENT DOCUMENTS

| | | | |
|---|---|---|---|
| 1019022 | 1/1953 | France | 70/459 |
| 1026327 | 4/1953 | France | 70/459 |
| 1407124 | 6/1965 | France | 70/456 B |
| 1456407 | 9/1966 | France | 70/459 |
| 2225 | of 1856 | United Kingdom | 24/3 K |
| 19238 | of 1912 | United Kingdom | 70/459 |

*Primary Examiner*—Lloyd A. Gall

[57] ABSTRACT

A keyring and attachment device, the key ring body being circular and having a gap closed by two bars, the attachment portion being a circular ring with a projecting hook. The two main components are joined with a small ring, the whole intended to hang within a pocket.

1 Claim, 1 Drawing Sheet

KEYRING AND ATTACHMENT

BACKGROUND—FIELD OF INVENTION

This invention relates to keyrings.

BACKGROUND DESCRIPTION OF PRIOR ART

Inventors have created many keyrings. They have especially attempted to solve the problems involved in making a durable locking mechanism from precious metals alloys. The attractiveness of such alloys creates a demand for keyrings made from them. Currently available are three types, as follows:

A. A Circular body with a portion missing to allow the placement of keys. Closing the gap is by means of an elongated wire band which is attached to a lever which is attached to one side of the gap by means of a pin. Placing the free end of the elongated ring in a notch on one side and pushing the lever down, secures the elongated ring, thus retaining the keys.

B. A horseshoe or differently shaped piece of rod with one secured terminal and the other terminal being removable by means of threads. The keys are placed on the rod and the threaded terminal replaced, thus retaining the keys.

C. A variation of "B" whereby the shape closes on itself and has only one terminal. This tubular terminal is threaded in one end to engage the threaded end of the rod. The rest of the inside of the tube is not threaded, but slides on the unthreaded portion of the rod. It is long enough to remain engaged on the rod after being screwed tight. Keyring type "A" typically fails to retain keys when the elongated ring stretches and the attachment points wear or break. Fingernails are often broken while working on the lever. Keyrings of type "B" and "C" fail when the threads wear. This causes the terminal or tube to become loose and fall off. The user tries to compensate by twisting the terminal fighter, eventually stripping the threads completely. In addition, the removable terminals are often dropped and lost while keys are removed and replaced. All the currently available keyrings manufactured from the softer alloys are poorly engineered in the latch portion. They typically have one or more parts of a thickness or design unsuited to the applied stress. This results in premature failure. The key retaining portion of the applicants' keyring is superior to any previous attempts. U.S. Pat. No. 2,090,962; Steven Peters, shows a keyring. The applicants' keyring eliminates parts 14 and 15 of the Peters Patent and substitutes two retained bars, 15 & 16 for Peters part 17, which has to be awkwardly removed and could be dropped. The hook portion of the keyring is a new and novel way of attaching and wearing a keyring. The keys remain secure by way of hanging inside the pocket. They remain accessible by virtue of an attachment hook which is easily found and grasped. Keyring fobs are often worn outside a pocket to facilitate the removal of the keys. The small hook is superior in that it is unobtrusive and less likely to catch or snag on an unrelated piece of clothing or furniture. The hook itself may be grasped, or the ring portion which is even easier.

Other keyrings which especially attempt to solve the soft alloy problem suffer a number of disadvantages:

a) They have parts which are small and/or thin and wear prematurely.

b) They rely on threads which wear prematurely.

c) Lack attractiveness and simplicity.

d) Do not provide an inside the pocket attachment hook.

OBJECTIVES AND ADVANTAGES a) To provide a keyring in an attractive alloy guaranteed against mechanical failure.

b) To provide a simple durable locking mechanism.

c) To provide a simple latch using alloys of an inherent hardness of about Rb 40 or less.

d) To overcome fatigue related stress failure in softer alloys with a latch designed to work within the correct parameters.

e) To create a functional article whose simple design adds to attractiveness.

f) To provide a keyring that does not fall to the bottom of the pocket and bulge uncomfortably.

g) To provide a device which remains accessible and easily grasped for retrieving the keyring from the pocket.

Further objectives and advantages are to provide a way of keeping keys from settling to the bottom of a pocket and there wearing holes or making tears in the fabric. The keys are enjoyable to carry around on the finger, with the finger through the ring attached to the hook. The wearer is more likely to put their keys back in the pocket, therefore life is more organized. The key can be retrieved easily even when the wearer is in a sitting position. Fingernails are not broken on a difficult latch. There are no parts to drop off or hold separately while placing or removing keys. The locking mechanism is virtually unbreakable. It fulfills the desire for an attractive and durable keyring of all precious metal. The desire for such items is demonstrated by various existing keyrings, none of which is comparable in attractiveness or functionality.

A description incorporating the drawing figures follows:

DRAWING FIGURES

REFERENCE NUMBERS IN DRAWINGS

10 attachment hook

11 retrieval ring

12 linking ring

13 linking arm with hole

14 latch arm

15 safety bar

16 latch bar

17 latch bar rest point, latch arm

17A latch bar rest point, linking arm

18 key retaining body

18A upset portion of key retaining body

19 safety bar hole, linking arm

19A latch bar hole, linking arm

20 safety bar hole, latch arm

20A latch bar hole, latch arm

Figure 1:
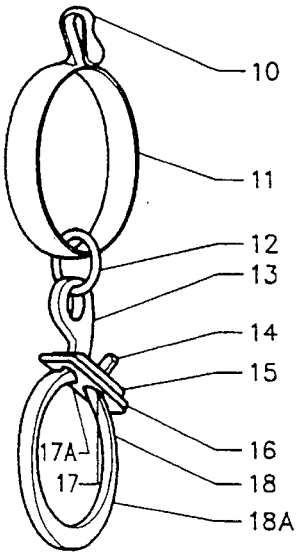
FIG. 1 shows an isometric view of a keyring
Figure 2:
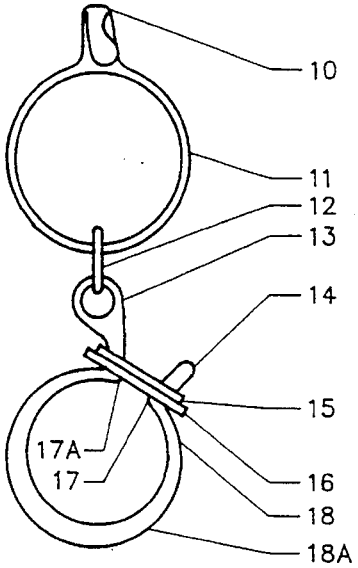
FIG. 2 shows a front view of a keyring
Figure 3:
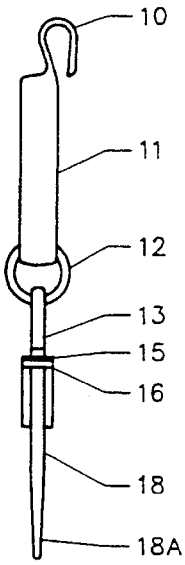
FIG. 3 shows a side view of a keyring
Figure 4:
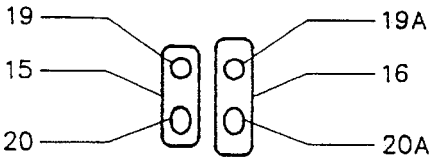
FIG. 4 shows a top view of two locking bars

Description of FIGS. 1 to 4:

A typical embodiment of the keyring is illustrated by the isometric view of FIG. 1. The keyring has an attachment hook 10 cast as a whole with retrieval ring 11. While this is the preferred embodiment, retrieval ring 11 could be replaced with any suitable object that allows the keys to locate far enough down in the pocket to be secure. Joining an attachment hook and retrieval ring is link ring 12. Other embodiments may join the retrieval hook 10–11 to the key retaining body 18 by other suitable means. This embodiment has a linking arm with hole 13 to be compatible with linking ring 12. Linking arm with hole 13 and latch arm 14 angle away from each other becoming more wide spread on the safety bar 15 side of latch rest points 17 and 17A. Below the latch rest points the key retaining body 18–18A is upset or flattened to provide work hardening resulting in resiliency. Further resiliency is obtained when body 18–18A is die struck. The portions of body 18–18A that are not upset are given additional rigidity resistance to bending by age hardening with heat. The remaining figures are: FIG. 2, a frontal view, FIG. 3, a lateral view, and FIG. 4, a frontal view of the latch bars. Two bars 15 and 16 retain the keys on body 18–18A. The preferred embodiment of one latch bar 16 and one safety bar 15, with holes 19, 19A, 20 and 20A is illustrated. The illustrated key retaining portion of the keyring is the preferred embodiment. However, the shape of body 18–18A along with arms 13 and 14 could be changed as long as correct function remains.

Operation—FIGS. 1–4:

The keys are placed by manually pressing on the portion of body 18–18A below latch resting points 17–17A. At the same time latch bars 15–16 are pulled up off latch arm 14. Latch bars 15–16 swing to the side and keys are mounted on the key retaining body 18–18A. The reverse procedure secures the keys. The key retainer and retrieval hook are then placed in a pocket and the hook grasps the pocket material. This suspends the entire device securely in the pocket ready for easy removal. Other ways of hanging the keyring may be possible.

SUMMARY, RAMIFICATIONS AND SCOPE

Accordingly, the reader will see that this invention is an improvement in the latch portion of a keyring and method of carrying. The latch has no small parts such as hinge pins and elongated rings to stretch and wear. The two latch bars replace three parts on one type of keyring. They do not require threads as do the other styles. A style of keyring, not currently available in soft alloy, which consists of a flattened coil requires a tedious round and round motion to remove and replace keys. No other keyring has a retrieval hook that allows keys to hang comfortably in the pocket. The same hook allows the keys to be removed easily from the pocket, even while sitting. The simplicity of the entire design lends it a pleasing attractiveness.

Although the above description contains many specifications, these should not be construed as limiting the scope of the invention, but merely provide illustration of presently preferred embodiment. For example: changes could be made to the shapes and sizes of any portions of the invention as long as it functions well and in a similar manner. It is possible that this invention may be used to retain other items with holes. For example: the link of a chain.

Thus the scope of the invention should be determined by the appended claims and their legal equivalents, rather than by the examples given.

We claim:

1. A key holding ring in combination with an attachment device, said attachment device comprising a hook projecting from a retrieval ring, said retrieval ring being joined to a linking ring, said linking ring being connected to a rounded terminus of a linking arm of said key holding ring, said key holding ring being resilient and generally circular in shape and having a gap defined by said linking arm and a latch arm, said gap being opened or closed by two flat, independent bars mounted below said terminus.

* * * * *